US007568917B1

(12) United States Patent
Malstrom et al.

(10) Patent No.: US 7,568,917 B1
(45) Date of Patent: Aug. 4, 2009

(54) LAMINATED ELECTRICAL CONTACT STRIP

(75) Inventors: Charles Randall Malstrom, Lebanon, PA (US); George Jyh-Shann Chou, Mechanicsburg, PA (US); Robert Daniel Hilty, Harrisburg, PA (US); Michael Fredrick Laub, Enola, PA (US); Peter David Wapenski, Foster, RI (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 12/013,182

(22) Filed: Jan. 11, 2008

Related U.S. Application Data

(60) Provisional application No. 61/020,329, filed on Jan. 10, 2008.

(51) Int. Cl.
*H01R 12/00* (2006.01)

(52) U.S. Cl. ..... 439/66; 439/862; 439/885

(58) Field of Classification Search ..... 439/66, 439/862, 885
See application file for complete search history.

(56) References Cited

U.S. PATENT DOCUMENTS

| | | | | |
|---|---|---|---|---|
| 3,954,317 | A * | 5/1976 | Gilissen et al. | 439/66 |
| 5,061,192 | A * | 10/1991 | Chapin et al. | 439/66 |
| 5,297,967 | A * | 3/1994 | Baumberger et al. | 439/66 |
| 5,462,440 | A * | 10/1995 | Rothenberger | 439/66 |
| 5,759,048 | A * | 6/1998 | Korsunsky et al. | 439/66 |
| 6,045,367 | A * | 4/2000 | Maldonado | 439/66 |
| 6,146,151 | A * | 11/2000 | Li | 439/66 |
| 6,375,474 | B1 * | 4/2002 | Harper et al. | 439/66 |
| 6,474,997 | B1 * | 11/2002 | Ochiai | 439/66 |
| 6,719,569 | B2 * | 4/2004 | Ochiai | 439/66 |
| 6,926,536 | B2 * | 8/2005 | Ochiai | 439/66 |
| 6,994,565 | B2 * | 2/2006 | Harper, Jr. | 439/66 |
| 7,025,601 | B2 * | 4/2006 | Dittmann | 439/66 |
| 7,059,865 | B2 * | 6/2006 | Kister et al. | 439/66 |
| 7,070,420 | B1 | 7/2006 | Wakefield et al. | |
| 7,448,877 | B1 * | 11/2008 | Pennypacker et al. | 439/66 |
| 2005/0208786 | A1 * | 9/2005 | Dittmann | 439/66 |
| 2008/0227307 | A1 * | 9/2008 | Alden et al. | 439/66 |

* cited by examiner

*Primary Examiner*—Tho D Ta

(57) ABSTRACT

A laminated electrical contact strip includes a plurality of electrical contacts. Each electrical contact includes a pair of opposite first and second surfaces extending between a pair of opposite end portions. A pair of first and second dielectric layers are laminated over the plurality of electrical contacts such that the first and second dielectric layers hold the plurality of electrical contacts therebetween. The first dielectric layer is bonded to and covers a portion of the first surface of each of the electrical contacts. The second dielectric layer is bonded to and covers a portion of the second surface of each of the electrical contacts.

20 Claims, 5 Drawing Sheets

LAMINATED ELECTRICAL CONTACT STRIP

CROSS REFERENCE TO RELATED APPLICATIONS

This application claims the benefit of U.S. Provisional Application No. 61/020,329 filed Jan. 10, 2008, the subject matter of which is herein incorporated by reference in its entirety.

BACKGROUND OF THE INVENTION

The subject matter described and illustrated herein relates generally to electrical contacts, and more particularly, to the electrical contacts of an interposer.

Interconnect devices are sometimes used to provide electrical connection between different electrical components, such as, but not limited to, integrated circuits and printed circuit boards, for example when removal, replacement, and/or testing of the electrical components is desired. Many of these electrical components have electrical contacts arranged in a "land grid array" (LGA) which is a two-dimensional array of contact pads. One type of interconnect device, known as an "interposer", has an array of electrical contacts which is placed between the two opposing arrays of the electrical components to provide an electrical connection between the electrical contacts of the opposing arrays.

Establishing reliable contact between the electrical contacts of the opposing electrical component arrays and the electrical contacts of the interposer may sometimes be difficult due to, for example, misalignment between electrical contacts of the opposing electrical component arrays and/or the electrical contacts of the interposer. Moreover, it may be difficult to provide the electrical contacts of the interposer with a shape that facilitates mechanical stability between the interposer and the electrical components. Some known interposers use elastomeric elements that are compressed by the electrical contacts of the opposing electrical component arrays such that the elastomeric elements apply a mechanical force to the electrical contacts to facilitate establishing and maintaining reliable electrical contact between the opposing electrical component arrays. Compression of the elastomeric elements may allow for some degree of misalignment of the electrical contacts of the interposer and/or the opposing electrical component arrays. However, at least some known interposers that use elastomeric elements may still suffer from misalignment and/or a less than desired mechanical stability between electrical contacts of the opposing electrical component arrays and/or the electrical contacts of the interposer. Moreover, some known interposers require that a substrate of the interposer be dielectric to electrically insulate the electrical contacts of the interposer from each other.

What is needed therefore is an interposer having less misalignment and/or greater mechanical stability than at least some known interposers. Moreover, what is needed is an interposer that does not require a dielectric substrate.

BRIEF DESCRIPTION OF THE INVENTION

In one embodiment, a laminated electrical contact strip is provided. The laminated electrical contact strip includes a plurality of electrical contacts. Each electrical contact includes a pair of opposite first and second surfaces extending between a pair of opposite end portions. First and second dielectric layers are laminated over the plurality of electrical contacts such that the first and second dielectric layers hold the plurality of electrical contacts therebetween. The first dielectric layer is bonded to and covers a portion of the first surface of each of the electrical contacts. The second dielectric layer is bonded to and covers a portion of the second surface of each of the electrical contacts.

In another embodiment, an electrical contact strip assembly is provided. The electrical contact strip assembly includes a base having opposite first and second base surfaces, a plurality of first elastomeric elements extending outwardly from the first base surface, and a plurality of second elastomeric elements extending outwardly from the second base surface. A laminated electrical contact strip is held by the base. The laminated electrical contact strip includes a plurality of electrical contacts. Each electrical contact includes a pair of opposite first and second surfaces extending between a pair of opposite first and second end portions. First and second dielectric layers are laminated over the plurality of electrical contacts such that the first and second dielectric layers hold the plurality of electrical contacts therebetween. The first dielectric layer is bonded to and covers a portion of the first surface of each of the electrical contacts. The second dielectric layer is bonded to and covers a portion of the second surface of each of the electrical contacts.

In another embodiment, an interposer is provided for electrically connecting a pair of electrical components. The interposer includes a substrate and an electrical contact strip assembly held by the substrate. The electrical contact strip assembly includes a base having opposite first and second base surfaces, a plurality of first elastomeric elements extending outwardly from the first base surface, and a plurality of second elastomeric elements extending outwardly from the second base surface. A laminated electrical contact strip is held by the base. The laminated electrical contact strip includes a plurality of electrical contacts. Each electrical contact includes a pair of opposite first and second surfaces extending between a pair of opposite first and second end portions. First and second dielectric layers is laminated over the plurality of electrical contacts such that the first and second dielectric layers hold the plurality of electrical contacts therebetween. The first dielectric layer is bonded to and covers a portion of the first surface of each of the electrical contacts. The second dielectric layer is bonded to and covers a portion of the second surface of each of the electrical contacts.

DETAILED DESCRIPTION OF THE INVENTION

Figure 1:
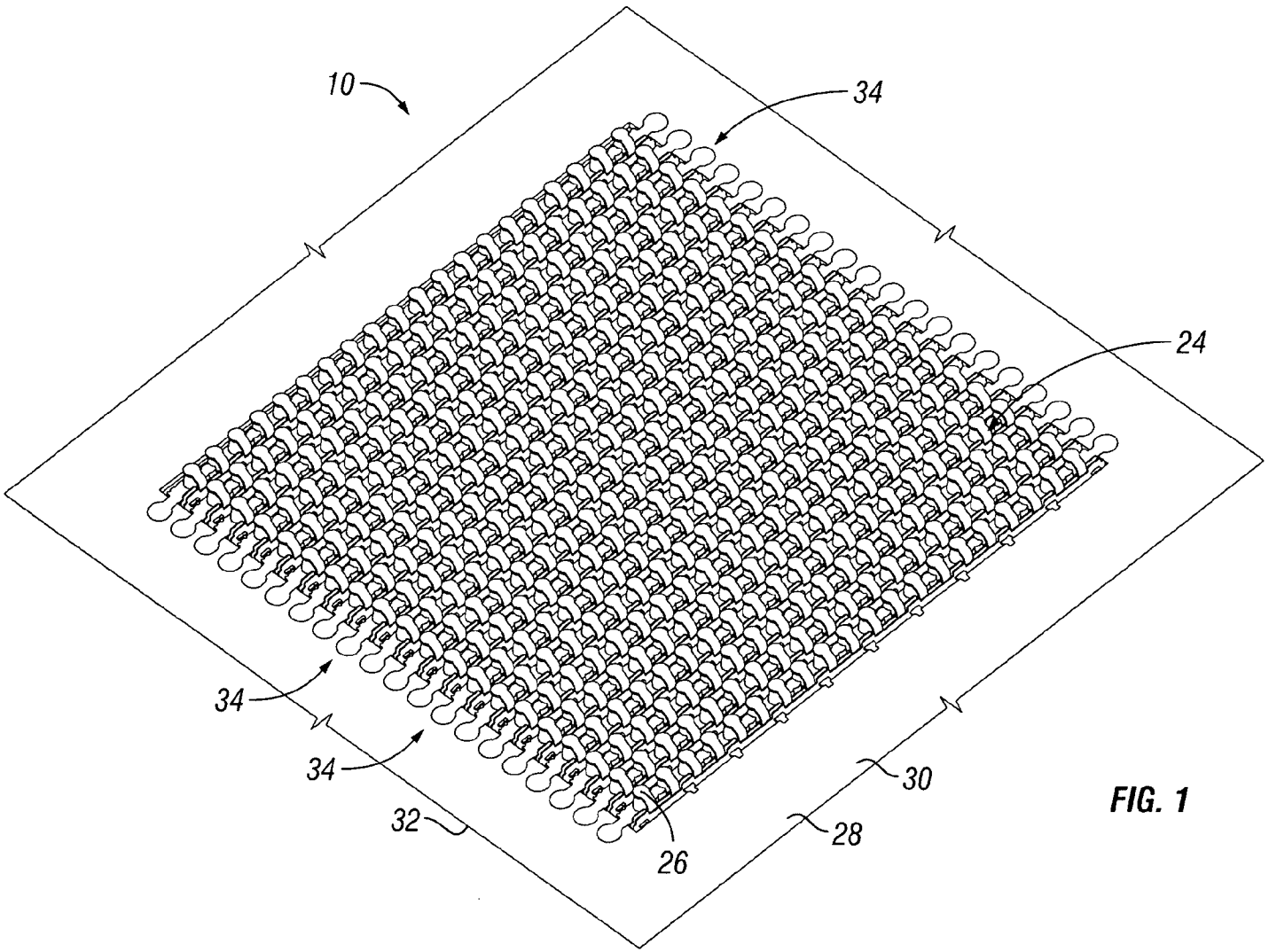
FIG. 1 is a perspective view an exemplary embodiment of an interposer.
Figure 2:
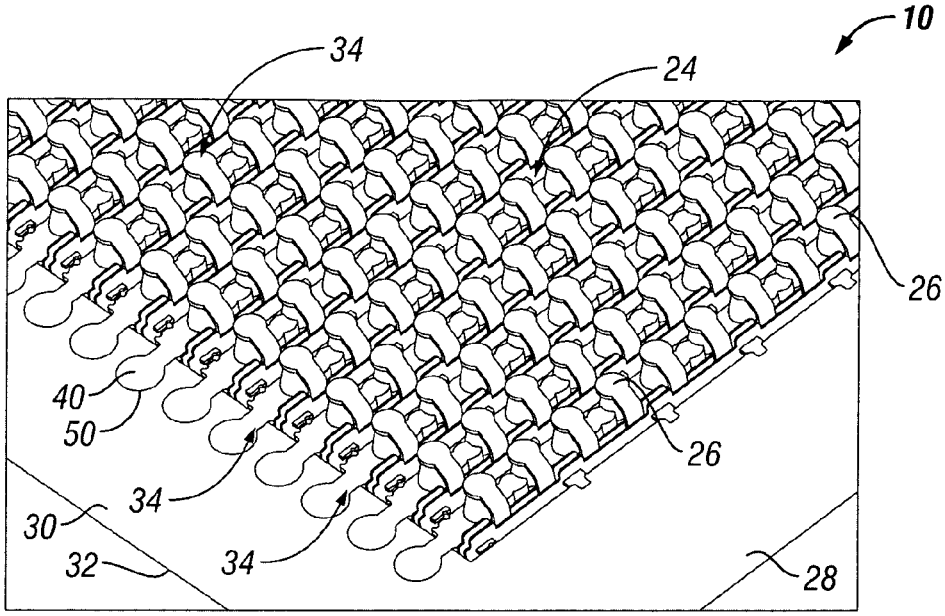
FIG. 2 is an enlarged perspective view of a portion of the interposer shown in FIG. 1.
Figure 3:
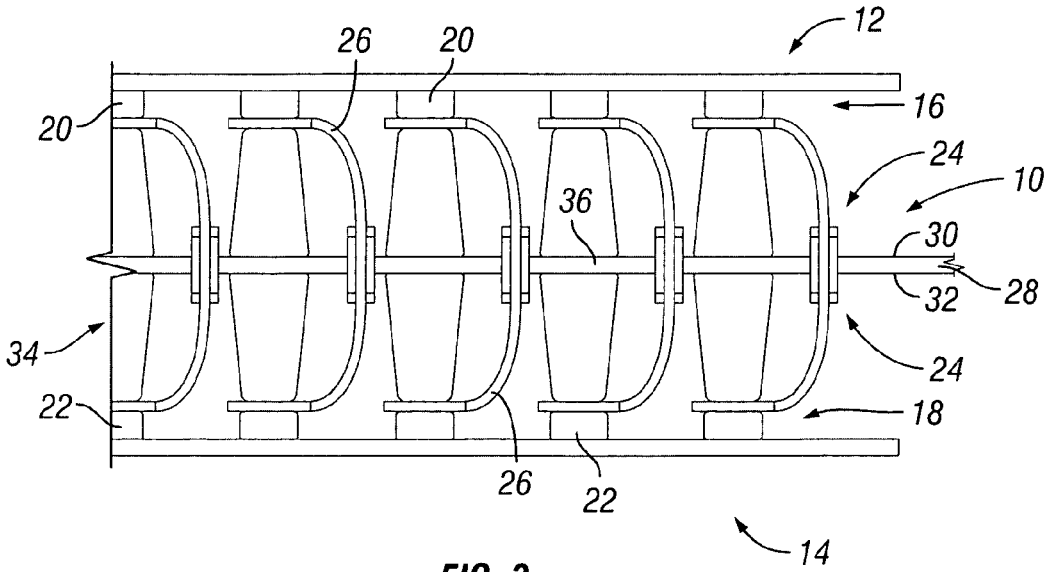
FIG. 3 is a cross-sectional view of a portion of the interposer shown in FIGS. 1 and 2 illustrating the interposer electrically connecting a pair of electrical components.

FIGS. 1 and 2 are perspective views an exemplary embodiment of an interposer 10. FIG. 3 is a cross-sectional view of a portion of the interposer 10 illustrating the interposer 10 electrically connecting a pair of electrical components 12 and 14. The electrical components 12, 14 each include a respective array 16 and 18 of a plurality of electrical contacts 20 and 22, respectively. The array 16 of the electrical component 12 substantially matches the pattern of the array 18 of the electrical component 14. The interposer 10 includes an array 24 of a plurality of electrical contacts 26 for electrically connecting the arrays 16 and 18 of the electrical components 12 and 14. The array 24 of the interposer 10 substantially matches the pattern of the arrays 16 and 18 of the electrical components 12 and 14, respectively.

The electrical components 12 and 14 may each be any suitable type of electrical component, such as, but not limited to, printed circuit boards, integrated circuits, electrical modules, and/or other electrical devices. The arrays 16 and 18 may each be any suitable type of array of electrical contacts that enables operative electrical connection between the electrical components 12 and 14, such as, but not limited to, Pin Grid Arrays (PGAs), Land Grid Arrays (LGAs), and/or Ball Grid Arrays (BGAs). Moreover, the arrays 16 and 18 may have any suitable configuration, arrangement, and/or pattern of electrical contacts that enables operative electrical connection between the electrical components 12 and 14.

The interposer 10 includes a substrate 28 having opposite surfaces 30 and 32 and a plurality of electrical contact strip assemblies 34 held by the substrate 28. Each electrical contact strip assembly 34 includes a plurality of the electrical contacts 26 held in a row. The electrical contacts 26 are spaced apart from each other within the corresponding row such that the electrical contacts 26 are electrically isolated from adjacent electrical contacts 26 within the corresponding row. In the exemplary embodiment, the electrical contact strip assemblies 34 are held by the substrate 28 in a side-by-side arrangement such that the electrical contact strip assemblies 34 form a plurality of rows of the electrical contacts 26. Although twenty electrical contact strip assemblies 34 are shown in FIG. 1, the interposer 10 may include any number of electrical contact strip assemblies 34. Moreover, although each electrical contact strip assembly 34 is shown in FIG. 1 as including twenty electrical contacts 26, each electrical contact strip assembly 34 may include any number of the electrical contacts 26. The pattern of the exemplary illustrated array 24 of the electrical contacts 26 that is formed by the exemplary electrical contact strip assemblies 34 and the manner in which they are held by the substrate 28 is meant as exemplary only. The array 24 may have any other suitable pattern(s) that enables the interposer 10 to electrically connect the electrical components 12 and 14.

The substrate 28 may be fabricated from any suitable material(s) that enables the substrate 28 to function as described herein, such as, but not limited to, Kapton®, polyethylene terephthalate (PET), polyimide, polyester, epoxy, other materials having a low and uniform dielectric constant, and/or electrically conductive materials, such as, but not limited to, metallic materials, such as, but not limited to, stainless steel. In some embodiments, the substrate 28 is fabricated entirely from one or more materials having a low and uniform dielectric constant. Alternatively, the substrate 28 is fabricated from one or more electrically conductive materials, such as, but not limited to, stainless steel. As will be described below, in some embodiments the substrate 28 need not be dielectric to electrically insulate, or isolate, the electrical contacts 26 from each other.

Figure 4:
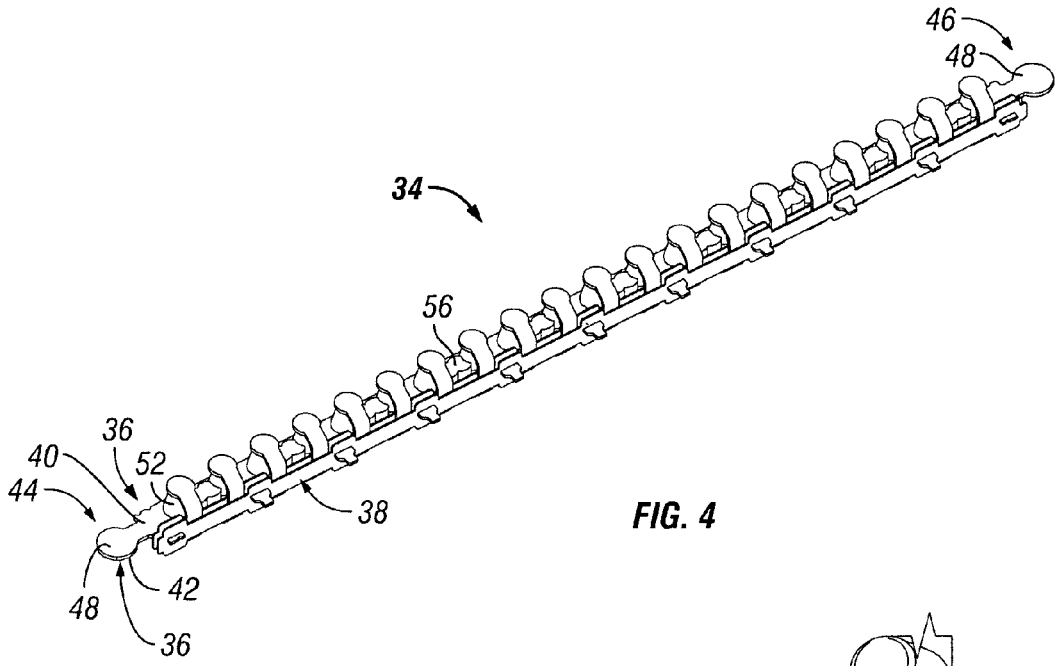
FIG. 4 is a perspective view of an exemplary embodiment of an electrical contact strip assembly of the interposer shown in FIGS. 1-3.
Figure 5:
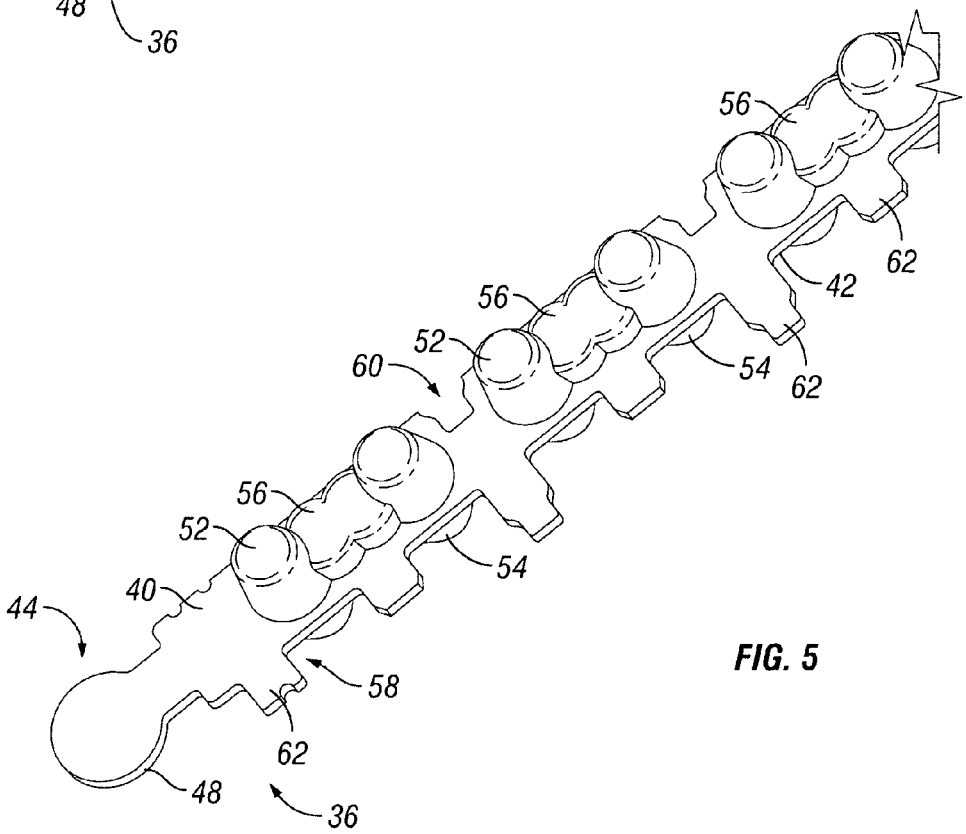
FIG. 5 is a perspective view of an exemplary embodiment of a portion of a base of the electrical contact strip assembly shown in FIG. 4.

FIG. 4 is a perspective view of an exemplary embodiment of an electrical contact strip assembly 34. The electrical contact strip assembly 34 includes a base 36 and a laminated electrical contact strip 38 held by the base 36. FIG. 5 is a perspective view of a portion of the base 36. Referring now to FIGS. 4 and 5, the base 36 includes opposite surfaces 40 and 42 that extend between a pair of opposite end portions 44 and 46. The surfaces 40 and 42 may each be referred to herein as a "first base surface" and/or a "second base surface". Each of the end portions 44 and 46 includes a retaining member 48 that is received within an opening 50 (FIG. 2) of the substrate 28 (FIGS. 1-3) to mount the electrical contact strip assembly 34 to the substrate 28. The retaining members 48 may be held within the corresponding opening 50 using any suitable structure, method, means, and/or the like, such as, but not limited to, welding, soldering, using an adhesive, using an interference fit, using a snap fit, and/or the like.

A plurality of elastomeric elements 52 extend outwardly from the surface 40, and a plurality of elastomeric elements 54 extend outwardly from the surface 42. The elastomeric elements 52 and 54 may each be referred to herein as a "first elastomeric element" and/or a "second elastomeric element". Each of the elastomeric elements 52 extends opposite a corresponding one of the elastomeric elements 54. The elastomeric elements 52 and 54 are compressible such that they apply a mechanical force, via the electrical contacts 26, to the electrical contacts 20 and 22 (FIG. 3) of the arrays 16 and 18 (FIG. 3), respectively, when the electrical components 12 and 14 are connected together by the interposer 10. In the exemplary embodiment, each elastomeric element 52 and 54 is secured to the respective base surface 40 and 42 using any structure, method, means, and/or the like, such as, but not limited to, using an adhesive. Alternatively, each elastomeric element 52 and 54 is partially received within a corresponding hole (not shown) within the substrate 28 and secured within the hole using any structure, method, means, and/or the like, such as, but not limited to, using an adhesive. In such an alternative embodiment, opposite corresponding elastomeric elements 52 and 54 may be connected together within the corresponding hole such that the opposite corresponding elastomeric elements 52 and 54 form an integral structure extending completely through the corresponding hole, whether the opposite corresponding elastomeric elements 52 and 54 are formed integrally or attached together.

The elastomeric elements 52 and 54 may be fabricated from any suitable material(s) that enable the elastomeric elements 52 and 54 to function as described herein, such as, but not limited to, silicone rubber, flourosilicone rubber, polyepoxide, polyimide, polybutadiene, neoprene, ethylene propylene diene monomer (EPDM), a thermoplastic elastomer, and/or polystyrene. The elastomeric elements 52 and 54 may have any suitable shape that enables the elastomeric elements 52 and 54 to function as described herein, such as, but not limited to, a cone, a truncated cone (a frustoconical shape), a pyramid, a truncated pyramid, a prism, and/or a hemisphere. In the exemplary embodiment, the elastomeric elements 52 and 54 include a frustoconical shape. Some or all the elastomeric elements 52 may optionally be connected together by a corresponding elastomeric member 56. Similarly, some or all of the elastomeric elements 54 may optionally be connected together by a corresponding elastomeric member 56. The elastomeric members 56 may facilitate preventing the elastomeric elements 52 and 54 from laterally deflecting when the electrical components 12 and 14 are connected together by the interposer 10.

The base 36 includes a pair of opposite side portions 58 and 60 that extend between the surfaces 40 and 42. The side portion 58 includes one or more extensions 62 that extend outwardly therefrom. As will be described below, the extensions 62 are each received within a corresponding opening 64 (FIGS. 6, 8, and 9) to mount the laminated electrical contact strip 38 to the base 36. The side portion 58 may include any number of extensions 62 for cooperating with any number of openings 64.

The base 36 may be fabricated from any suitable material(s) that enables the base 36 to function as described herein, such as, but not limited to, Kapton®, polyethylene terephthalate (PET), polyimide, polyester, epoxy, other materials having a low and uniform dielectric constant, and/or electrically conductive materials, such as, but not limited to, metallic materials, such as, but not limited to, stainless steel. In some embodiments, the base 36 is fabricated entirely from one or more materials having a low and uniform dielectric constant. Alternatively, the base 36 is fabricated from one or more electrically conductive materials, such as, but not limited to, stainless steel. As will be described below, in some embodiments the base 36 need not be dielectric to electrically insulate, or isolate, the electrical contacts 26 from each other.

Figure 6:
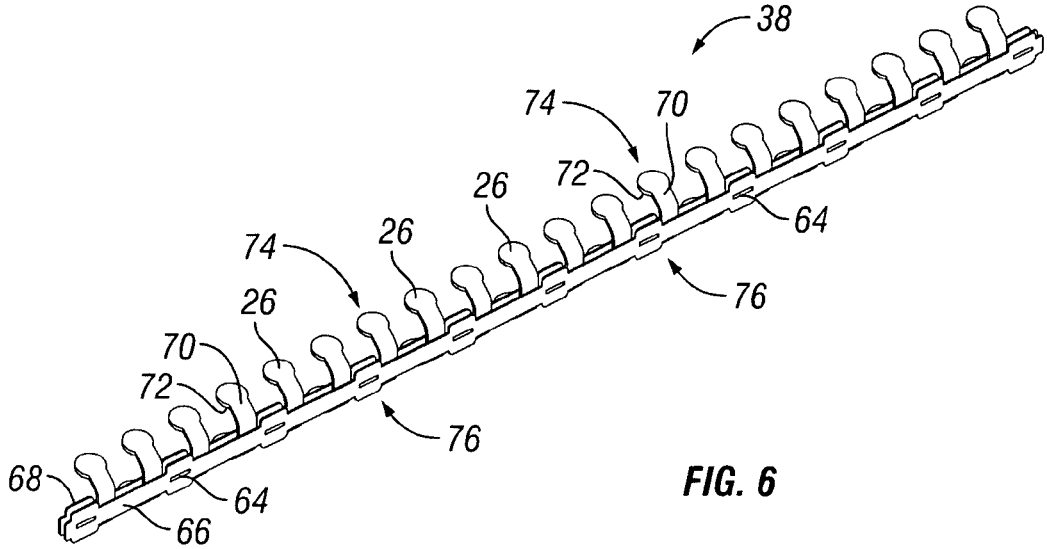
FIG. 6 is a perspective view of an exemplary embodiment of a laminated electrical contact strip of the electrical contact strip assembly shown in FIG. 4.
Figure 7:
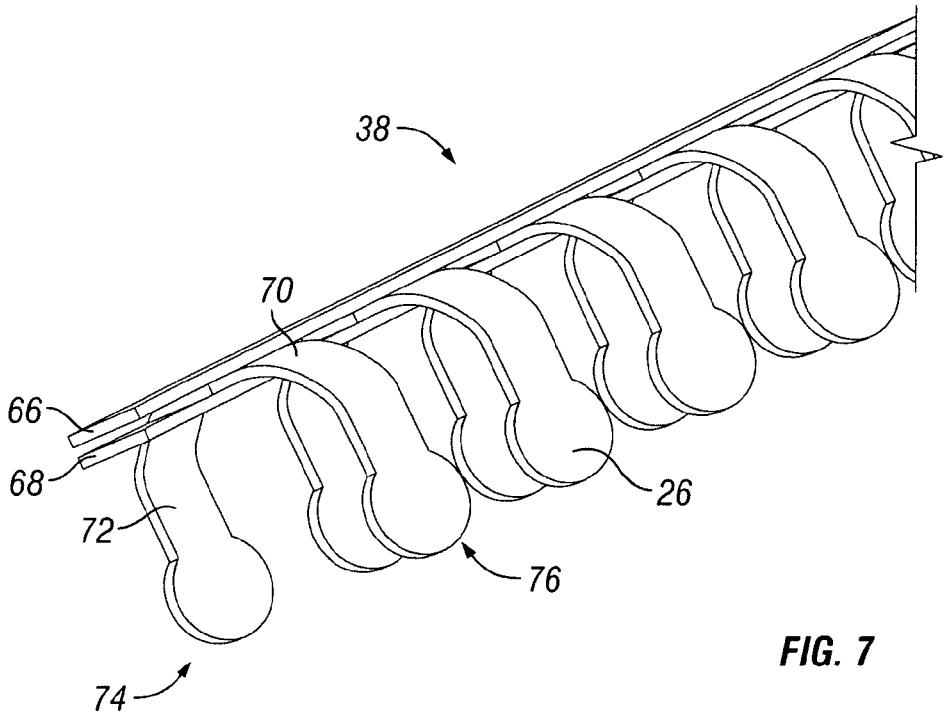
FIG. 7 is a perspective view of a portion of the laminated electrical contact strip shown in FIG. 6.

FIGS. 6 and 7 are perspective views of an exemplary embodiment of a laminated electrical contact strip 38. The laminated electrical contact strip 38 includes a plurality of the electrical contacts 26 and a pair of dielectric layers 66 and 68 that hold the electrical contacts 26. The pair of dielectric layers 66 and 68 may each be referred to herein as a "first dielectric layer" and/or a "second dielectric layer". Each electrical contact 26 includes a pair of opposite surfaces 70 and 72 that extend between a pair of opposite end portions 74 and 76. The surfaces 70 and 72 may each be referred to herein as a "first surface" and/or a "second surface". The end portions 74 and 76 may each be referred to herein as a "first end portion" and/or a "second end portion". When assembled as shown in FIGS. 6 and 7, in the exemplary embodiment each of the electrical contacts 26 includes an approximate C-shape. The electrical contacts 26 may have any other suitable shape that enables the electrical contacts 26 to function as described herein.

The dielectric layers 66 and 68 are laminated over the electrical contacts 26 such that the dielectric layers 66 and 68 hold the electrical contacts 26 therebetween. Specifically, the dielectric layer 66 is bonded to, and covers, a portion of the surface 70 of each of the electrical contacts 26, and the dielectric layer 68 is bonded to, and covers, a portion of the surface 72 of each of the electrical contacts 26. The dielectric layers 66 and 68 may be laminated over the electrical contacts 26 using any suitable method, process, structure, means, and/or the like. In some embodiments, lamination may include providing an adhesive between the dielectric layer 66 and 68 and the respective contact surface 70 and 72 to facilitate bonding the dielectric layers 66 and 68 to the electrical contacts 26.

As described above, the electrical contacts 26 are held by the dielectric layers 66 and 68 in a row such that the electrical contacts 26 are spaced apart from each other along the length of the row. Between some or all of the adjacent pairs of electrical contacts 26, the dielectric layers 66 and 68 may include the opening 64. As described in more detail below, the openings 64 each receive a corresponding extension 62 (FIGS. 5, 8, and 9) therein to mount the laminated electrical contact strip 38 to the base 36 (FIGS. 3-5, 8, and 9). The dielectric layers 66 and 68 may include any number of openings 64 for cooperating with any number of extensions 62.

The electrical contacts 26 may be fabricated from any suitable material(s) that enable the electrical contacts 26 to function as described herein, such as, but not limited to, copper, aluminum, silver, nickel, palladium, platinum, rhodium, rhenium, tin, and/or gold. Non-noble metals covered with a conductive layer may be used as a base material(s) to provide strength and/or rigidity. Such non-noble metals may be covered with a barrier metal that is covered with a surface structure of a noble metal to ensure chemical inertness and provide suitable asperity distribution to facilitate good metal-to-metal contact.

The dielectric layers 66 and 68 may be fabricated from any suitable material(s) that enables the dielectric layers 66 and 68 to function as described herein, such as, but not limited to, Kapton®, polyethylene terephthalate (PET), polyimide, polyester, epoxy, other materials having a low and/or uniform dielectric constant, and/or the like.

Figure 8:
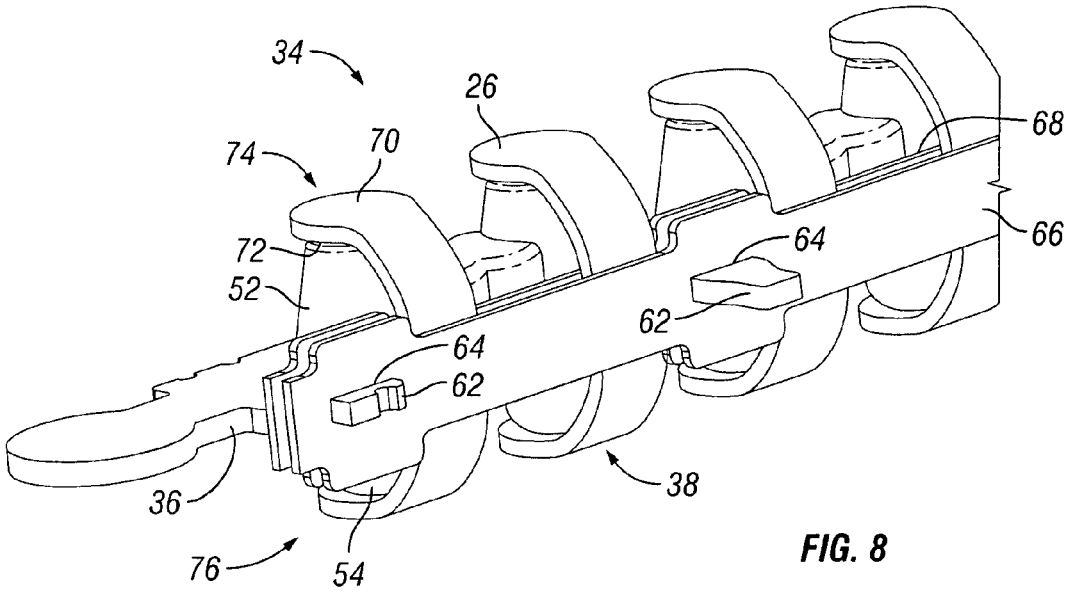
FIG. 8 is a perspective view of a portion of the electrical contact strip assembly shown in FIG. 4.
Figure 9:
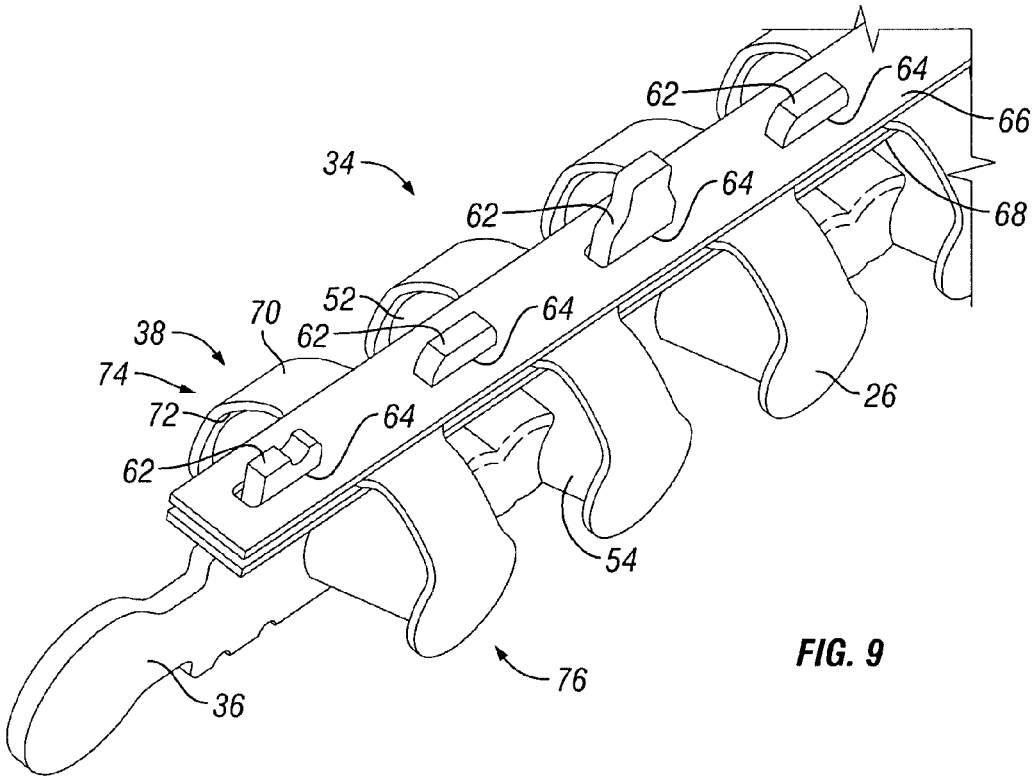
FIG. 9 is another perspective view of a portion of the electrical contact strip assembly shown in FIG. 4.

FIGS. 8 and 9 are perspective views of a portion of the electrical contact strip assembly 34. Each extension 62 of the base 36 is received within a corresponding one of the openings 64 of the laminated electrical contact strip 38 to mount the laminated electrical contact strip 38 to the base 36. The openings 64 and the extensions 62 may each have any suitable size and/or shape that enable the openings 64 and the extensions 62 to cooperate to mount the laminated electrical contact strip 38 to the base 36. In some embodiments, the extensions 62 may be able to move, or float, relative to the openings 64 when the extensions 62 are received within the openings such that the base 36 can move, or float, relative to the laminated electrical contact strip 38 when the strip 38 is mounted to the base 36. The extensions 62 may be held within the corresponding opening 64 using any suitable structure, method, means, and/or the like, such as, but not limited to, using an adhesive, using an interference fit, using a snap fit, and/or the like. Moreover, any other suitable arrangement, structure, method, means, and/or the like may be used in addition or alternative to the openings 64 and the extensions 62 to mount the laminated electrical contact strip 38 to the base 36, such as, but not limited to, using an adhesive to mount the laminated contact strip 38 to the base 36.

When the base 36 and the laminated electrical contact strip 38 are assembled as shown in FIGS. 8 and 9, the surface 72 of each of the electrical contacts 26 engages a corresponding one of the elastomeric elements 52 at the end portion 74 of the electrical contact 26. The surface 72 of each of the electrical contacts 26 also engages a corresponding one of the elastomeric elements 54 at the end portion 76 of the electrical contact 26. The dielectric layers 66 and 68 insulate each of the electrical contacts 26 from the base 36, from adjacent bases 36 when the electrical contact strip assembly 34 is held by the substrate 28 (FIGS. 1-3), and from the substrate 28 itself. Accordingly, the substrate 28 and/or the base 36 may each optionally be fabricated from an electrically conductive material(s).

The embodiments described and illustrated herein may provide an interposer having less misalignment and/or greater mechanical stability than at least some known interposers. Moreover, the embodiments described and illustrated herein may provide an interposer that does not require a dielectric substrate.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

While the subject matter described and illustrated herein has been described in terms of various specific embodiments, those skilled in the art will recognize that the subject matter described and illustrated herein can be practiced with modification within the spirit and scope of the claims.

What is claimed is:

1. A laminated electrical contact strip comprising:

a plurality of electrical contacts, each electrical contact comprising a pair of opposite first and second surfaces extending between a pair of opposite end portions, the second surface of each of the plurality of electrical contacts being configured to engage an elastomeric element at both of the end portions of the electrical contact; and first and second dielectric layers laminated over the plurality of electrical contacts such that the first and second dielectric layers hold the plurality of electrical contacts therebetween, the first dielectric layer bonded to and covering a portion of the first surface of each of the electrical contacts, the second dielectric layer bonded to and covering a portion of the second surface of each of the electrical contacts.

2. The laminated electrical contact strip according to claim 1, further comprising an adhesive joining the first and second dielectric layers to the first and second surfaces, respectively, of the plurality of electrical contacts.

3. The laminated electrical contact strip according to claim 1, wherein the first and second dielectric layers hold the plurality of electrical contacts in a row such that the plurality of electrical contacts are spaced apart from each other within the row.

4. The laminated electrical contact strip according to claim 1, wherein the first and second dielectric layers hold the plurality of electrical contacts in a row such that the plurality of electrical contacts are spaced apart from each other within the row, the first and second dielectric layers comprising a mounting opening between two adjacent electrical contacts, the mounting opening being configured to receive an extension of a base to hold the laminated electrical contact strip on the base.

5. The laminated electrical contact strip according to claim 1, wherein each of the plurality of electrical contacts comprises an approximate C-shape.

6. An electrical contact strip assembly comprising:

a base having opposite first and second base surfaces;

a plurality of first elastomeric elements extending outwardly from the first base surface;

a plurality of second elastomeric elements extending outwardly from the second base surface; and a laminated electrical contact strip held by the base, the laminated electrical contact strip comprising:

a plurality of electrical contacts, each electrical contact comprising a pair of opposite first and second surfaces extending between a pair of opposite first and second end portions; and first and second dielectric layers laminated over the plurality of electrical contacts such that the first and second dielectric layers hold the plurality of electrical contacts therebetween, the first dielectric layer bonded to and covering a portion of the first surface of each of the electrical contacts, the second dielectric layer bonded to and covering a portion of the second surface of each of the electrical contacts.

7. The electrical contact strip assembly according to claim 6 wherein the second surface of each of the plurality of electrical contacts engages a corresponding one of the first elastomeric elements at the first end portion, and the second surface of each of the plurality of electrical contacts engages a corresponding one of the second elastomeric elements at the second end portion.

8. The electrical contact strip assembly according claim 6, wherein the base comprises a metallic material.

9. The electrical contact strip assembly according to claim 6, wherein the laminated electrical contact strip further comprises an adhesive joining the first and second dielectric layers to the first and second surfaces, respectively, of the plurality of electrical contacts.

10. The electrical contact strip assembly according to claim 6, wherein the first and second dielectric layers hold the plurality of electrical contacts in a row such that the plurality of electrical contacts are spaced apart from each other within the row.

11. The electrical contact strip assembly according to claim 6, wherein the first and second dielectric layers hold the plurality of electrical contacts in a row such that the plurality of electrical contacts are spaced apart from each other within the row, the first and second dielectric layers comprising an opening between two adjacent electrical contacts, the base comprising an extension received within the opening.

12. The electrical contact strip assembly according to claim 6, wherein each of the plurality of electrical contacts comprises an approximate C-shape.

13. The electrical contact strip assembly according to claim 6, wherein each of the first elastomeric elements is connected to a corresponding one of the second elastomeric elements.

14. The electrical contact strip assembly according to claim 6, wherein each of the first elastomeric elements is unitarily formed with a corresponding one of the second elastomeric elements.

15. The electrical contact strip according to claim 6, wherein the first elastomeric elements are spaced apart from each other along the base, a plurality of the first elastomeric elements being connected together by an elastomeric member.

16. An interposer for electrically connecting a pair of electrical components, said interposer comprising:

a substrate; and an electrical contact strip assembly held by the substrate, the electrical contact strip assembly comprising:

a base having opposite first and second base surfaces;

a plurality of first elastomeric elements extending outwardly from the first base surface;

a plurality of second elastomeric elements extending outwardly from the second base surface; and a laminated electrical contact strip held by the base, the laminated electrical contact strip comprising:

a plurality of electrical contacts, each electrical contact comprising a pair of opposite first and second surfaces extending between a pair of opposite first and second end portions; and first and second dielectric layers laminated over the plurality of electrical contacts such that the first and second dielectric layers hold the plurality of electrical contacts therebetween, the first dielectric layer bonded to and covering a portion of the first surface of each of the electrical contacts, the second dielectric layer bonded to and covering a portion of the second surface of each of the electrical contacts.

17. The interposer according to claim 16 wherein the second surface of each of the plurality of electrical contacts engages a corresponding one of the first elastomeric elements at the first end portion, and the second surface of each of the plurality of electrical contacts engages a corresponding one of the second elastomeric elements at the second end portion.

18. The interposer according to claim 16, wherein the base comprises a metallic material.

19. The interposer according to claim 16, wherein the substrate comprises a metallic material.

20. The interposer according to claim 16, wherein the first elastomeric elements are spaced apart from each other along the base, two adjacent first elastomeric elements being connected together by a dielectric member.

* * * * *